US007596349B2

(12) United States Patent
Ishiduka

(10) Patent No.: US 7,596,349 B2
(45) Date of Patent: Sep. 29, 2009

(54) RECORDING MATERIAL, SMOOTHING SYSTEM, AND IMAGE-FORMING SYSTEM

(75) Inventor: Jiro Ishiduka, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 216 days.

(21) Appl. No.: 11/861,167

(22) Filed: Sep. 25, 2007

(65) Prior Publication Data

US 2008/0090161 A1 Apr. 17, 2008

(30) Foreign Application Priority Data

Oct. 11, 2006 (JP) ..... 2006-277727

(51) Int. Cl.
*G03G 15/20* (2006.01)

(52) U.S. Cl. ..... 399/341; 430/124.5; 428/195.1; 428/212; 399/342

(58) Field of Classification Search ..... 399/320, 399/341, 342; 430/124.5, 124, 53, 124.54; 428/195.1, 212
See application file for complete search history.

(56) References Cited

U.S. PATENT DOCUMENTS

2005/0271409 A1* 12/2005 Omata ..... 399/73

FOREIGN PATENT DOCUMENTS

JP 04-216580 A 8/1992
JP 04-362679 A 12/1992

* cited by examiner

*Primary Examiner*—David M Gray
*Assistant Examiner*—G. M. Hyder
(74) *Attorney, Agent, or Firm*—Canon U.S.A., Inc., IP Division

(57) ABSTRACT

A recording material has toner reception layers on both surfaces of a base. The toner reception layers have glass transition temperatures in the range of 40 to 80° C. One of the toner reception layers that is to be smoothed prior to the other toner reception layer has a higher glass transition temperature than the other toner reception layer. The toner reception layer having a lower glass transition temperature is smoothed at a higher speed than the other toner reception layer.

16 Claims, 11 Drawing Sheets

BEFORE SMOOTHING

AFTER SMOOTHING

RECORDING MATERIAL, SMOOTHING SYSTEM, AND IMAGE-FORMING SYSTEM

BACKGROUND OF THE INVENTION

1. Field of the Invention

The present invention relates to a recording material having imaging surfaces to be smoothed at both sides, a smoothing system that smooths the imaging surfaces, and an image-forming system that forms toner images on the imaging surfaces and smooths the imaging surfaces.

2. Description of the Related Art

Electrophotographic image-forming apparatuses have widely been known, and many types of such image-forming apparatuses have been commercialized, including full color type as well as monochrome type. Demand for high quality images is rising as the image-forming apparatuses are increasingly used in a variety of fields.

It is, for example, required that glossiness, which is one of factors to enhance the image quality, be increased. The glossiness is affected by, for example, the smoothness of output images.

Responding to such a demand, Japanese Patent Laid-Open Nos. 04-216580 and 04-362679 each have disclosed an apparatus that forms glossy images by embedding a toner image to a recording material having a thermoplastic transparent resin layer (hereinafter referred to as resin medium). The resin layer of the resin medium has a glass transition temperature of 85° C. or less.

In the above described apparatus, the toner image formed on the transparent resin layer is fixed by a fixing device. The toner image is then heated to melt together with the resin layer by a glossy belt of a smoothing unit. Then, the resin medium is cooled by a cooling device while it is conveyed with close contact with the belt, and is thus separated from the belt. Consequently, the entire surface of the resin medium is smoothed according to the glossy surface of the belt. The cooling of the resin medium before being separated from the belt can reduce the toner or resin layer offset to the fixing roller and prevent the surface of the resin medium from being roughened.

There is another demand for forming glossy images on both surfaces of a resin medium. More specifically, a double-sided resin medium having the transparent resin layer at both sides is used.

Unfortunately, the double-sided resin medium having the transparent resin layer at both sides causes the following problem.

Specifically, the previously smoothed resin layer (imaging surface) is roughened while the resin layer at the other side is smoothed. Thus, the glossiness of the previously smoothed imaging surface is seriously degraded. It is thus difficult to produce high-quality glossy images on both surfaces of a double-sided resin medium.

SUMMARY OF THE INVENTION

An embodiment of the present invention provides a recording material having toner reception layers at both surfaces that can be appropriately smoothed after toner images are formed on.

An embodiment of the present invention also provides a smoothing system that appropriately smooths the toner reception layers.

An embodiment of the present invention further provides an image-forming system that forms toner images on the toner reception layers and appropriately smooths the toner reception layers.

Further features of the present invention will become apparent from the following description of exemplary embodiments with reference to the attached drawings.

DESCRIPTION OF THE EMBODIMENTS

The present invention will be further described in detail with reference to the following embodiments. While the embodiments illustrate some of the best modes of the invention, the invention is not limited to the embodiments.

First Embodiment

Figure 1:
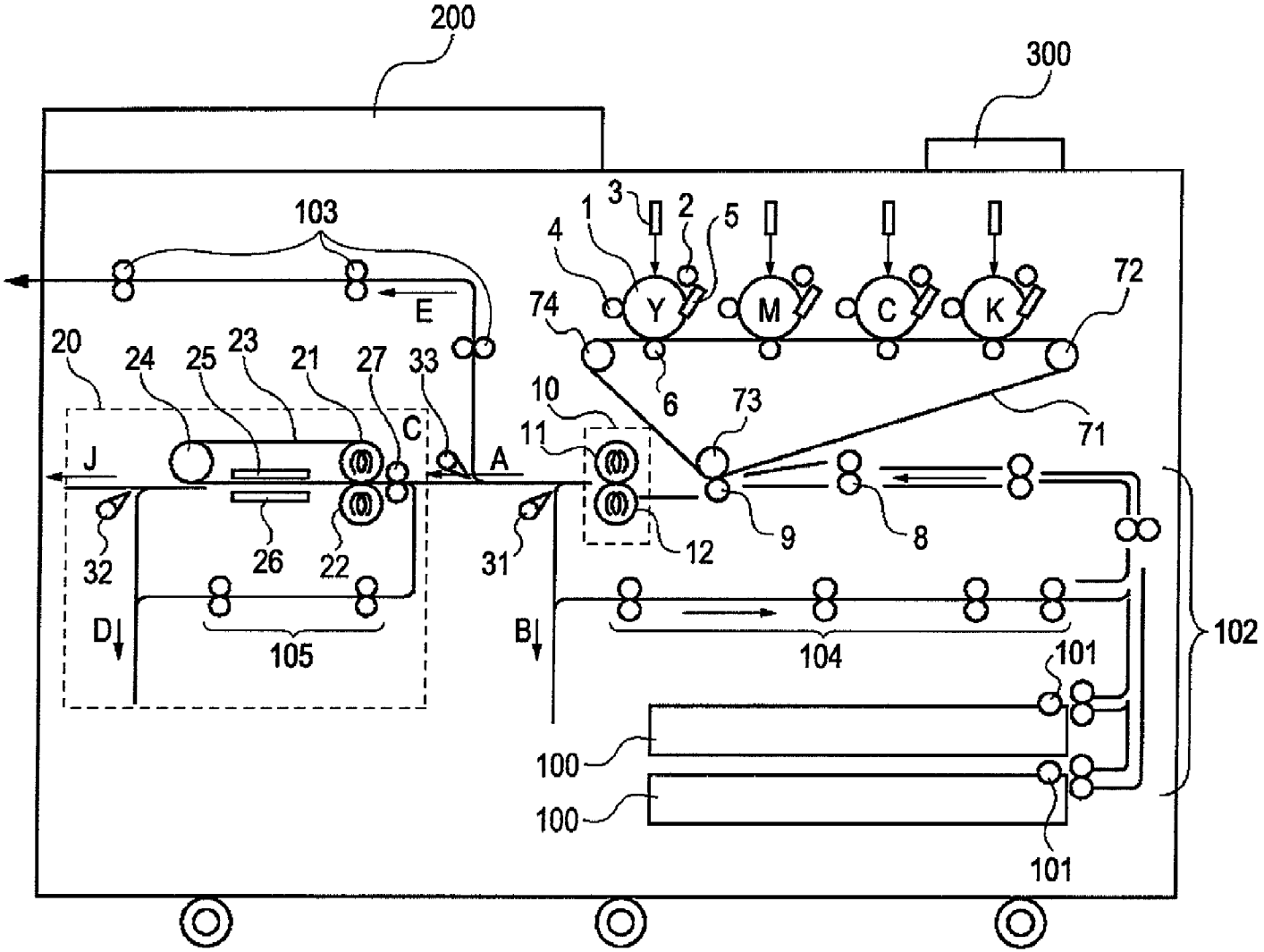
FIG. 1 is a schematic sectional view of an image-forming apparatus.

FIG. 1 is a schematic diagram of an electrophotographic image-forming apparatus (image-forming system) according to an embodiment of the present invention. The image-forming apparatus is a color multifunctional machine including a copying function using an intermediate transfer member and a printing function.

The image-forming system of the present embodiment includes a main enclosure containing a below-described image-forming unit and a fixing device and a sub enclosure (smoothing system) containing a below-described smoothing unit and a recording material conveying mechanism. The sub enclosure is an optional unit that can be removably attached to the main enclosure according to the decision of the user. The unit enclosed by the main enclosure can complete the formation of a toner image on a normal recording material, such as plain paper.

The image-forming system may be an image-forming apparatus defined by a single enclosure containing an image-forming unit, a fixing device, and a smoothing unit.

Toner Image-Forming Section

The image-forming unit (engine section) that forms a toner image on a recording material, such as plain paper, OHP sheet, or a below-described resin medium, will first be described. The image-forming unit has the following structure.

The image-forming apparatus includes a document reader 200 at an upper portion. The document reader 200 reads the image information of an original placed thereon. The image information read by the document reader 200 is image-processed, and an exposure unit (described later) is controlled according to the image-processed data.

An operational section 300 is provided at a side of the document reader 200. The user programs and directs the image-forming unit through the operational section 300. An image-forming mode (described later) is selected or designated through the operational section 300, and a controller 400 (FIG. 6) controls the image forming unit, the fixing device, and the smoothing unit according to the information selected or designated.

The image-forming unit includes four image-forming stations Y, M, C, and K that are substantially horizontally arranged at an upper portion of the image-forming apparatus. The image-forming stations Y, M, C, and K are intended to form yellow toner images, magenta toner images, cyan toner images, and black toner images, respectively. The image-forming stations have substantially the same structure, except that the toners acting as developers have different colors from one another.

The following description illustrates the image-forming station Y, but the same applies to the other image-forming stations M, C, and K.

The image-forming station Y includes a rotatable photoreceptor (hereinafter referred to as photosensitive drum) 1 acting as an image carrier. The photosensitive drum 1 has a charging roller 2 as charging means, an exposure unit 3 for exposing images to light, a developer device 4 for development, a primary transfer roller 6 and a cleaner 5 around it.

An intermediate transfer belt 71 acting as an intermediate transferring member is rotatably disposed so as to come into contact with the photosensitive drum 1. The intermediate transfer belt 71 traverses a follower roller 72, an opposing secondary transfer roller 73, and a drive roller 74 driven by a drive motor. The primary transfer roller 6 opposes the photosensitive drum 1 with the intermediate transfer belt 71 pinched therebetween. The follower roller 72 doubles as a tension roller to apply a predetermined tension to the intermediate transfer belt 71. The opposing secondary transfer roller 73 opposes a secondary transfer roller 9 with the intermediate transfer belt 71 pinched therebetween. A secondary transfer bias voltage is applied to the opposing secondary transfer roller 73 from a high-voltage power supply during secondary transfer.

At least one cassette 100 is provided to hold recording materials below the intermediate transfer belt 71. In the present embodiment, two cassettes 100 are disposed so that different types of recording materials are held in different cassettes.

Pickup rollers 101 are provided so that the recording materials held in the respective cassettes 100 are separately conveyed one after another.

A recording material conveyed by pickup roller 101 is further conveyed to a resist roller pair 8 through a plurality of conveying roller pairs 102. The resist roller pair 8 controls the timing of sending out the recording material so that the timing of introducing the toner image on the intermediate transfer belt 71 into the secondary transfer section coincides with the timing of introducing the recording material into the secondary transfer section.

How the image-forming section operates will now be described.

The above-described components of the image-forming unit are each operated (rotated) at a process speed of about 130 mm/s. An exposure scanning speed of the exposure unit 3 is set according to the movement of the photosensitive drum 1 rotated at the process speed.

The surface of the photosensitive drum 1 rotated counterclockwise shown in FIG. 1 is uniformly charged by the charging roller 2, and laser light is emitted from the exposure unit 5 according to an image signal, thereby forming an electrostatic latent image. The electrostatic latent image is turned into a visible image by applying a developer to the latent image with the developer device 4. The toner image formed on the photosensitive drum 1 is primary-transferred to the intermediate transfer belt 71 by applying a primary transfer bias voltage to the primary transfer roller 6.

Such steps up to the step of developing are performed for each image-forming station. Toner images for the respective colors are primary-transferred onto the intermediate transfer belt 71 so as to overlap one another. More specifically, a yellow, a magenta, a cyan, and a black toner image formed by the respective image-forming stations are transferred onto the intermediate transfer belt 71 so as to overlap one another, thus forming a color image.

Then, a secondary bias voltage is applied to the opposing secondary transfer roller 73, so that the toner images on the intermediate transfer belt 71 are secondary-transferred together onto the recording material introduced to the secondary transfer section.

The recording material on which the color image has been transferred is conveyed to the fixing device 10 and the color image is fixed.

Fixing Device

The fixing device 10 is disposed downstream from the secondary transfer section in the direction in which the recording material is conveyed.

The fixing device 10 includes a fixing roller 11 or a fixing member and a pressure roller 12 that presses the fixing roller 11 to form a fixing nip. The total pressure between the fixing roller 11 and the pressure roller 12 is set at about 50 kg.

The fixing roller 11 has a multilayer structure including an elastic rubber layer and a fluorocarbon layer for releasing the toner on a hollow metal core of, for example, Al or Fe. The metal core contains a halogen heater as a heat source in the hollow. Other heat sources may be used, such as an IH heater based on electromagnetic induction.

The fixing roller 11 is connected to a drive motor through a drive gear line so as to be rotated by the driving force of the drive motor. In the present embodiment, the fixing speed (recording material conveying speed), that is, the peripheral speed of the fixing roller 11 and the pressure roller 12 is set at 80 mm/s.

The pressure roller 12, as well as the fixing roller 11, has a multilayer structure including an elastic rubber layer and a fluorocarbon layer for releasing the toner on a hollow metal core, and contains a halogen heater as a heat source in the hollow. Other heat sources may be used, such as an IH heater based on electromagnetic induction.

The pressure roller 12 is a follower of the fixing roller 11 and is rotated together with the fixing roller.

Thermistors for detecting the temperatures of the fixing roller 11 and the pressure roller 12 are disposed at the vicinities of their respective surfaces. The controller 400 controls the energization of the halogen heaters contained in the fixing roller 11 and the pressure roller 12 according to the outputs from the thermistors. In order to favorably fix unfixed toner images, it is preferable that the fixing temperature of the fixing device 10 is set in the range of 100 to 200° C. In the present embodiment, the fixing temperatures of the fixing roller 11 and the pressure roller 12 are set at 180° C. and 150° C., respectively, and these temperatures are maintained by the controller.

The fixing device 10 used in the present embodiment heats and presses the toner image of the recording material conveyed from the secondary transfer section, at the fixing nip, thereby fixing the toner image on the recording material.

The temperature of the recording material when it is conveyed out of the fixing device 10 (recording material stripping temperature) is kept high (about 90 to 110° C.). Thus, the fixing device 10 of the present embodiment is of high-temperature separation type, and the recording material is separated from the fixing device 10 as soon as the recording material is passed through the fixing nip.

Although the above-described fixing device 10 is defined by the pair of rollers, the fixing roller 11 and the pressure roller 12, at least one of the rollers may be replaced with a belt.

Resin Medium

Figure 3:
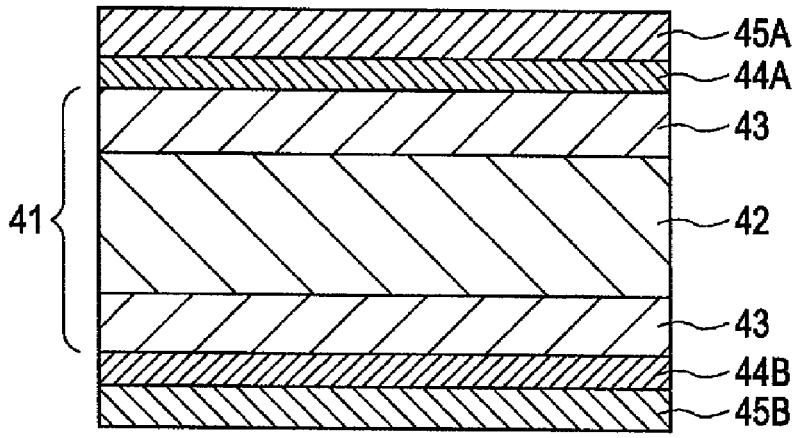
FIG. 3 is a schematic representation of a layered structure of a double-sided resin medium.

Turning now to FIG. 3, a recording material having toner reception layers at both surfaces (hereinafter referred to as a double-sided resin medium) will now be described. The double-sided resin medium is used in a below-described double-side image-forming mode for forming glossy images on both sides of the medium (double-sided photo output mode). The resin medium is often used in the fields of, for example, photography, brochures, advertising handbills, P.O.P., and advertising display, and is suitable to produce high quality printed matter.

The toner reception layer used herein can be defined as a resin layer in which the toner (image) can be embedded by smoothing (image heating treatment). Since the toner reception layer is softened together with the toner by the smoothing and is thus compatible with the toner, it can be called a toner compatible layer.

The double-sided resin medium of the present embodiment may be a so-called RC paper (resin-coated paper) 41 having resin layers 43 formed of a polyethylene resin on both surfaces of a base paper 42 by laminating or coating.

The properties of the surfaces of the RC paper 41 affect the quality of the surfaces of the final printing product. Desirably, the RC paper 41 is finished so as to have highly smooth surfaces.

In an embodiment, the RC paper 41 has intermediate layers 44A and 44B and toner reception layers 45A and 45B at both sides. The intermediate layers 44A and 44B and the toner reception layers 45A and 45B may not be necessarily formed. If they are not provided, the resin layers serve as the toner reception layers. Now, the intermediate layer and toner reception layer at one imaging surface side onto which toner images will previously be transferred are designated by 44A and 45A, respectively, and the intermediate layer and toner reception layer at the other imaging surface side onto which the toner image will subsequently be transferred are designated by 44B and 45B, respectively. The toner reception layer may be designated by 45 when its front and back surfaces do not need to be discriminated.

In an embodiment, the toner has a glass transition temperature Tg in the range of 40 to 80° C. This is because a toner having a glass transition temperature Tg of lower than 40° C. is liable to cause blocking in a developer device (before an unfixed toner image is formed on the recording material). In contrast, a toner having a glass transition temperature Tg of higher than 80° C. requires that the temperature of the smoothing unit be set excessively high. The glass transition temperature Tg of the toner can be measured by a method described later.

The toner reception layer 45 is made of a transparent thermoplastic resin and has a thickness in the range of about 5 to 30 μm. In an embodiment, the toner reception layer 45 is made of the same polyester resin as the toner so that the toner and the toner reception layer can be fused and softened during smoothing. In other words, it is preferable that the transparent thermoplastic resin of the toner reception layer be compatible with the toner.

The polyester resin of the toner reception layer is constituted of a polyhydric alcohol component and a multivalent carboxylic acid component.

Examples of the polyhydric alcohol component include ethylene glycol, propylene glycol, 1,4-butanediol, 2,3-butanediol, diethylene glycol, triethylene glycol, 1,5-pentanediol, and 1,6-hexanediol, and besides neopentyl glycol, 1,4-cyclohexanedimethanol, dipropylene glycol, polyethylene glycol, polypropylene glycol, and monomers prepared by adding an olefin oxide to bisphenol A.

Examples of the polyvalent carboxylic acid component include maleic acid, maleic anhydride, fumaric acid, phthalic acid, terephthalic acid, isophthalic acid, malonic acid, succinic acid, glutaric acid, dodecylsuccinic acid, n-octylsuccinic acid, and n-dodecylsuccinic acid, and besides 1,2,4-benzenetricarboxylic acid, 1,2,4-cyclohexanetricarboxylic acid, 1,2,4-naphthalenetricarboxylic acid, and 1,2,5-hexanetricarboxylic acid. The polyvalent carboxylic acids may also include 1,3-dicarboxy-2-methyl-2-methylenecarboxypropanetetra(methylenecarboxy)methane, 1,2,7,8-octanetetracarboxylic acid, trimellitic acid, and pyromellitic acid. Furthermore, lower alkyl esters or the like of those acids may be used.

The polyester resin of the transparent toner reception layer is prepared by synthesizing at least one of the above-listed polyhydric alcohol components and at least one of the above-listed polyvalent carboxylic acid components.

The toner reception layer may further contain a pigment, a release agent, an electroconductive agent, and other additives as long as the transparency of the toner reception layer is not degraded. In this instance, the content of the principal constituents of the toner reception layer is preferably 80% by weight or more relative to the total weight of the resin layer. The composition of the toner reception layer is preferably adjusted so that the surface electrical resistance of the transparent resin layer is $8.0\times10^{8}\Omega$ or more at a temperature of 20° C. and a relative humidity of 85%.

The resin medium may not necessarily have a multilayer structure as long as it has a thermoplastic resin layer whose surface is so fusible as it can be melted around the fixing temperature. An additive may also be added, such as a pigment.

TABLE 1

| Glass transition temperature (° C.) | Offset resistance | Embedment |
|---|---|---|
| 20 | Bad | Good |
| 30 | Fair | Good |
| 40 | Good | Good |
| 50 | Good | Good |

TABLE 1-continued

| Glass transition temperature (° C.) | Offset resistance | Embedment |
|---|---|---|
| 60 | Good | Good |
| 70 | Good | Good |
| 80 | Good | Good |
| 90 | Good | Fair |

Preferably, the glass transition temperature Tg of the front and back toner reception layers 45 of the resin medium is set in the range of 40 to 80° C. This is because a toner reception layer having a glass transition temperature of less than 40° C. causes the toner to be offset to the smoothing unit described later, and because a toner reception layer having a glass transition temperature of more than 80° C. results in insufficient embedment of the toner in the toner reception layer, as shown in the test results of Table 1.

The resin medium used in an embodiment has a front and a back toner reception layer 45 made of polyester resins having different glass transition temperatures Tg.

Specifically, the toner reception layer 45A to which the toner image will be previously transferred is made of a polyester resin A having a glass transition temperature Tg of 50° C., and the other toner reception layer 45B to which the toner image will subsequently be transferred is made of polyester resin B having a glass transition temperature Tg of 60° C.

The glass transition temperatures Tg of resins A and B can be adjusted by varying their molecular weights. More specifically, polyester resin B having a lower glass transition temperature Tg contains a larger amount of low molecular weight components than polyester resin A. Consequently, polyester resin B having a lower glass transition temperature Tg than polyester resin A can be easily fused, and accordingly the toner can be more easily embedded in the toner reception layer made of resin B by smoothing.

Toner reception layers made of different polyester resins each having a glass transition temperature Tg in the range of 40 to 80° C. were measured for their average molecular weights, and the molecular weights were all in the range of 5,000 to 16,000. This suggests that a toner reception layer having an average molecular weight in this range can prevent the offset of the toner or the failure of toner embedment (see Table 2).

TABLE 2

| Average molecular weight | Offset resistance | Embedment |
|---|---|---|
| 3000 | Bad | Good |
| 4000 | Fair | Good |
| 5000 | Good | Good |
| 6000 | Good | Good |
| 8000 | Good | Good |
| 10000 | Good | Good |
| 12000 | Good | Good |
| 15000 | Good | Good |
| 16000 | Good | Good |
| 18000 | Good | Fair |
| 20000 | Good | Bad |

The glass transition temperature Tg of the toner reception layer 45 was measured with a differential scanning calorimeter (DSC analyzer), DCS-7 (manufactured by PerkinElmer), or DSC2920 (manufactured by TA instruments Japan) in accordance with the method specified in ASTM (D3418-82).

The weight of samples to be measured can be 5 to 20 mg, and 10 mg of samples were weighed out. Each sample was placed in an aluminum pan and subjected to the below-described heat cycles in the measuring temperature range of 30 to 200° C. with an empty aluminum pan as a reference.

First, the sample pan and the reference pan were heated (heating I) under the following conditions to eliminate the influence of water and were subsequently cooled (cooling II).

Then, the sample pan and the reference pan were heated (heating II) under the following conditions. The temperature curve (DSC curve) of the resin of the toner reception layer can be obtained from the deference of temperature curves obtained from the measurements.

Measurement conditions, heating I: 30° C. to 200° C., heating rate 10° C./min cooling I: 200° C. to 30° C., cooling rate 10° C./min heating II: 30° C. to 200° C., heating rate 10° C./min The glass transition temperature Tg can be obtained from the heating II DSC curve by the mid-point method.

In an embodiment, the basis weight of the entire double-sided resin medium is preferably in the range of 100 to 300 g/m$^2$, and more preferably in the range of 170 to 250 g/m$^2$ from the viewpoint of producing a silver halide photographic texture and ease of conveying the medium in the apparatus.

A single-sided resin medium having the toner reception layer at one side may be used. The single-sided resin medium includes a resin layer 43 formed of a polyethylene resin on one surface of a base paper 42 by laminating or coating, and further an intermediate layer 44 and a toner reception layer 45 formed in that order. The single-sided resin medium is used in a single-sided image-forming mode for forming glossy images on one side of the medium (single-sided photo output mode).

Smoothing Unit

In an embodiment, the smoothing unit smooths the imaging surface of the medium to enhance the glossiness of the resulting images in modes for forming glossy images on the above-described resin medium (photo output modes). For this purpose, the smoothing unit is of cooling separation type. The smoothing system used herein includes the smoothing unit and a recording material-conveying mechanism that can reverse the recording material (double-sided resin medium) and introduces the recording material to the smoothing unit again.

The smoothing unit 20 includes a glossy endless belt 23, a pressure roller 22 that forms a nip between the pressure roller 22 and the belt 23, and cooling devices 25 and 26.

The belt 23 transfers its glossy surface state to the resin medium by being heated with in contact with the imaging surface of the resin medium. The belt 23 used in an embodiment has a glossiness (60°) in the range of 60 to 100. The glossiness of the belt 23 can be arbitrarily selected according to the glossiness of images required of the image-forming apparatus.

For an embodiment, the glossinesses (of the belt 23 and the resin medium imaging surface) were measured at an incident angle of 60° in accordance with JIS Z 8741 using a handy gloss meter (PG-1M) manufactured by Nippon Denshoku Industries.

The belt 23 includes a base made of a thermosetting resin, such as polyimide. The base may be made of a heat-resistant resin or a metal. A heat-resistant silicone rubber layer is formed as an elastic layer on the base. As an alternative to the silicone rubber, a fluorocarbon rubber may be used. In addition, a fluorocarbon layer is formed as a toner release layer on the silicone rubber layer.

The thickness of the belt 23 can be in the range of 100 to 300 μm. An excessively small thickness results in an insufficient strength of the belt and an insufficient pressure for embedding the toner to the toner reception layer. In contrast, an excessively large thickness requires a higher heat for heating the belt and accordingly may result in an insufficient embedment of the toner.

The belt 23 rotatably traverses a heat roller 21 and a tension roller 24. In the present embodiment, the heat roller 21 is connected to a drive motor through a drive gear so as to serve as a drive roller to drive the belt 23.

The smoothing speed (peripheral speed of the belt 23) can be controlled by switching the number of revolutions of the drive motor by the controller, and at least two smoothing speeds are available. More specifically, the belt 23 can be set so as to run at either peripheral speed of 50 mm/s or 80 mm/s. The belt runs at the lower speed of 50 mm/s during the warm-up of the smoothing unit and in a stand-by state.

The heat roller 21 is a hollow roller including a heat-conducting metal core and an elastic rubber layer formed on the metal core. More specifically, the metal core of the heat roller 21 is an aluminum hollow pipe having a diameter of 44 mm and a thickness of 5 mm, and the rubber layer is made of a silicone rubber having a JIS-A hardness of 50° and a thickness of 300 μm. A halogen heater is disposed as a heat source inside the heat roller 21. The heat source may be, for example, an IH heater based on electromagnetic induction.

A thermistor for detecting the temperature of the belt 23 is provided at the vicinity of the outer surface of the belt 23 opposing the heat roller 21. The controller 400 controls the energization of the halogen heater according to the output from the thermistor, so that the portion of the belt 23 wound around the heat roller 21 is kept a temperature of about 130° C.

The tension roller 24 is located at a position where the recording material is separated from the belt 23 due to the curvature. In other words, the diameter of the tension roller 24 is set so that the recording material is self-striped (peeled) from the belt 23 due to its stiffness.

A pressure roller 22 is rotatably disposed so as to oppose the heat roller 21 with the belt 23 therebetween. The pressure roller 22 is rotated by following the movement of the belt 23.

The pressure roller 22 includes a hollow metal core and an elastic rubber layer on the metal core. The rubber layer is made of a silicone rubber having a thickness of about 3 mm. In the present embodiment, the pressure roller also contains a heat source such as a halogen heater and heats the recording material, as well as the heat roller 21. The heat source may be, for example, an IH heater based on electromagnetic induction.

The pressure roller 22 and the heat roller 21 are pressed at a total pressure of 50 kg (490 N) with the belt 23 therebetween. More specifically, the pressure roller 22 forms a nip between the pressure roller 22 and the belt 23. The nip has a length of about 5 mm in the direction in which the recording material is conveyed.

A thermistor for detecting the temperature of the pressure roller 22 is provided at the vicinity of the outer surface of the pressure roller 22. The controller 400 controls the energization of the halogen heater according to the output from the thermistor, so that the pressure roller 22 is kept a temperature of about 90° C.

The resin medium heated and pressed at the nip between the belt 23 and the pressure roller 22 is conveyed to the cooling section defined by the cooling devices 25 and 26, with the belt 23 in close contact with the resin medium. In the present embodiment, the cooling fans are used as the cooling devices 25 and 26, and the cooling fans cool the belt 23 in the cooling section. The cooling devices 25 and 26 each have an inner duct and an outer duct inside and outside the cooling section. The air from the cooling fans 25 and 26 passes through the ducts.

The cooling devices 25 and 26 are set so as to cool the toner reception layer and the toner to their respective glass transition temperatures by the time when the resin medium arrives at the position where it is stripped. Since the toner and the toner reception layer of the present embodiment are mainly formed of the same resin, their transition temperatures are substantially the same.

Thus the smoothing unit used in an embodiment is of low-temperature separation type in which the recording material separation temperature is sufficiently lower than in the above-described fixing device 10, and in which the recording material is separated after being cooled to low temperature.

The cooling device is not limited to the above device, and may be a heat pipe containing a refrigerant, such as water, or a structure that cools an object by bringing the object into contact with a heat sink or a Peltier element. The cooling device may be disposed only at one side of the belt 23 so that only a single side of the belt 23 is cooled.

In operation, the smoothing unit operates in the following manner.

On introducing the resin medium of about 80° C. subjected to fixing in the fixing device 10 into the smoothing unit, the imaging surface of the resin medium is heated and pressed at the nip. In this instance, the resin medium is heated to a temperature sufficiently higher than the glass transition temperature Tg of the toner, specifically, to about 110° C. As a result, the toner reception layer of the resin medium, as well as the toner, is fused and softened, so that the toner is embedded in the toner reception layer.

Then, the resin medium is conveyed to the cooling section, with the belt 23 in close contact with the resin medium, and cooled to the glass transition temperature Tg of the toner or less, about 50° C., with the cooling devices 25 and 26. Thus, the imaging surface of the resin medium comes to high gloss, depending on the glossy surface of the belt 23, and is thus smoothed. The sufficiently cooled resin medium is self-stripped at the separation position due to the stiffness of the resin medium. Consequently, the toner and the resin of the toner reception layer are prevented from offsetting to the belt 23 to roughen the imaging surface.

The smoothed resin medium is ejected to the outside, and thus a process for forming images on the resin medium is completed.

Single-Sided Image-Forming Mode

The image-forming apparatus of the present embodiment has two single-sided image-forming modes for forming toner images only on one side of recording materials. The operator can choose either of the two modes, using an operational screen (liquid crystal display) shown in FIG. 7 displayed in the operational section of the image-forming apparatus. If the image-forming apparatus is used as a printer, such an operation can be performed using, for example, a printer driver screen as shown in FIG. 8 displayed on an external apparatus networked with the image-forming apparatus.

One of the single-sided image-forming modes is a normal mode in which toner images formed on one side of a recording material, such as plain paper, is fixed by the fixing device 10, and subsequently the recording material is immediately ejected. This mode, that is, the mode using normal materials such as plain paper, is called the normal output mode.

The other single-sided image-forming mode is a special mode in which toner images formed on the toner reception layer of a single-sided resin medium is fixed by the fixing device 10 and subsequently the resin medium is smoothed by the smoothing unit 20 and then ejected. The mode in which toner images are formed on a single-sided resin medium as above is called the photo output mode. The mode using a double-sided resin medium as the recording material is also referred to as the photo output mode.

Figure 4A:
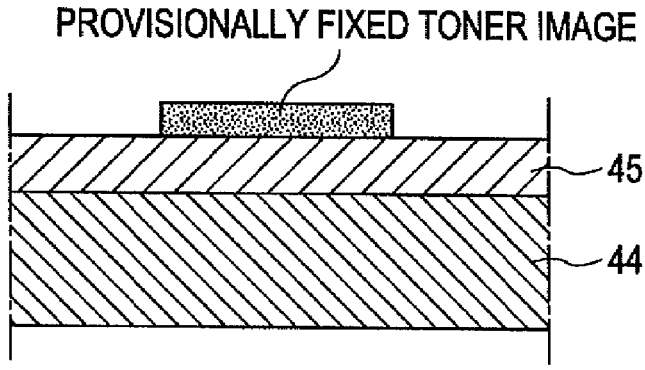
FIGS. 4A and 4B are representations of the double-sided resin medium before and after smoothing.

In the photo output mode, the toner images onto the toner reception layer described above is fixed to the extent that the toner will not be offset to the conveying rollers (see FIG. 4A). In other words, such fixing may be referred to as "provisional fixing" and is different in fixing conditions and fixing results from the fixing performed in the normal single-sided image-forming mode.

The block diagram shown in FIG. 6 will now be described.

Figure 6:
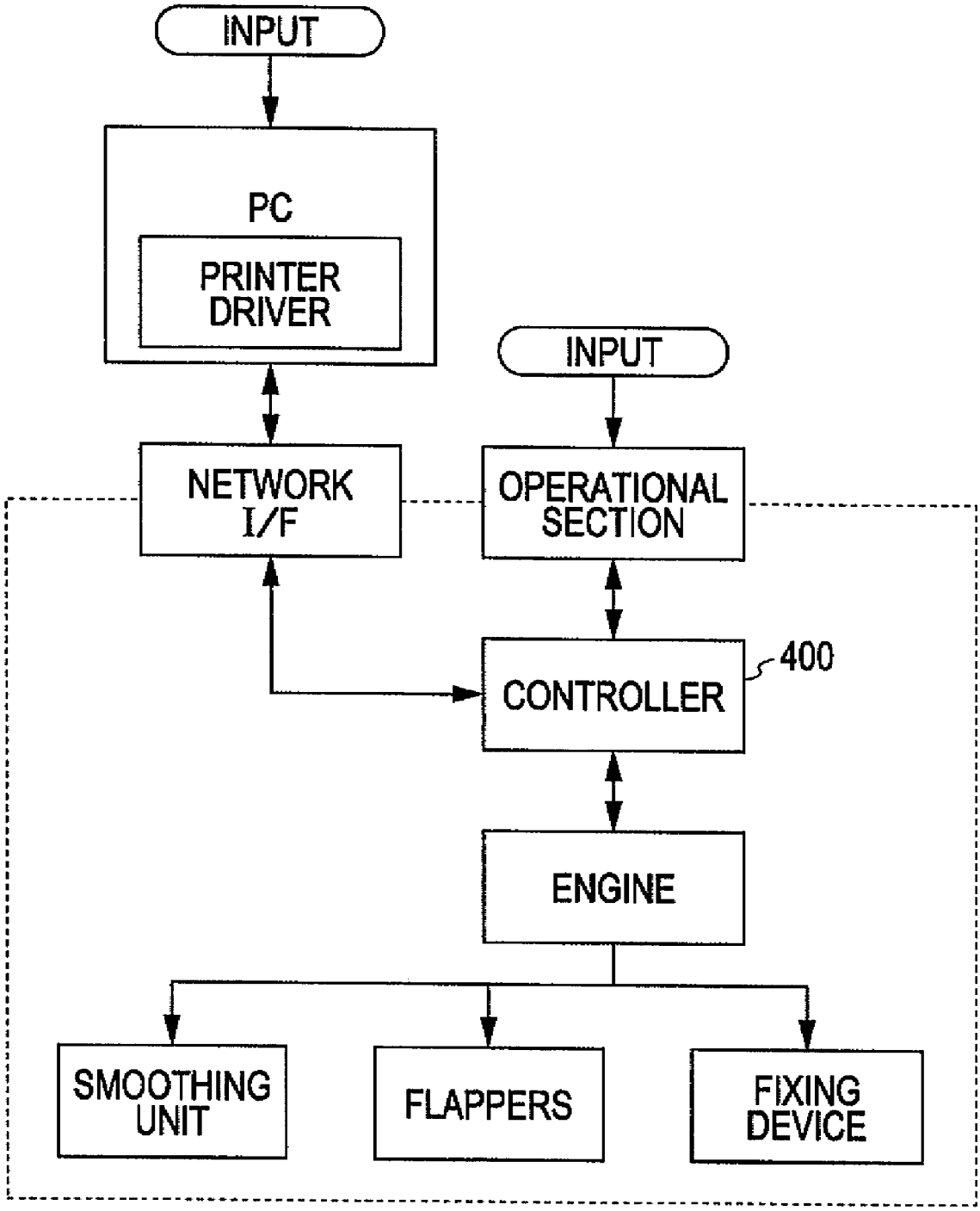
FIG. 6 is a block diagram of an image-forming apparatus and an external apparatus networked with the image-firming apparatus.

The devices in the region surrounded by the dotted line in FIG. 6 are installed in the image-forming apparatus (image-forming system). The device outside the dotted line is a personal computer as an external apparatus and is networked to the image-forming system through a LAN cable.

The controller 400 is connected to the engine (image-forming unit), the smoothing unit, below-described flappers (conveying path switching means) and the fixing device, and controls them.

Figure 7:
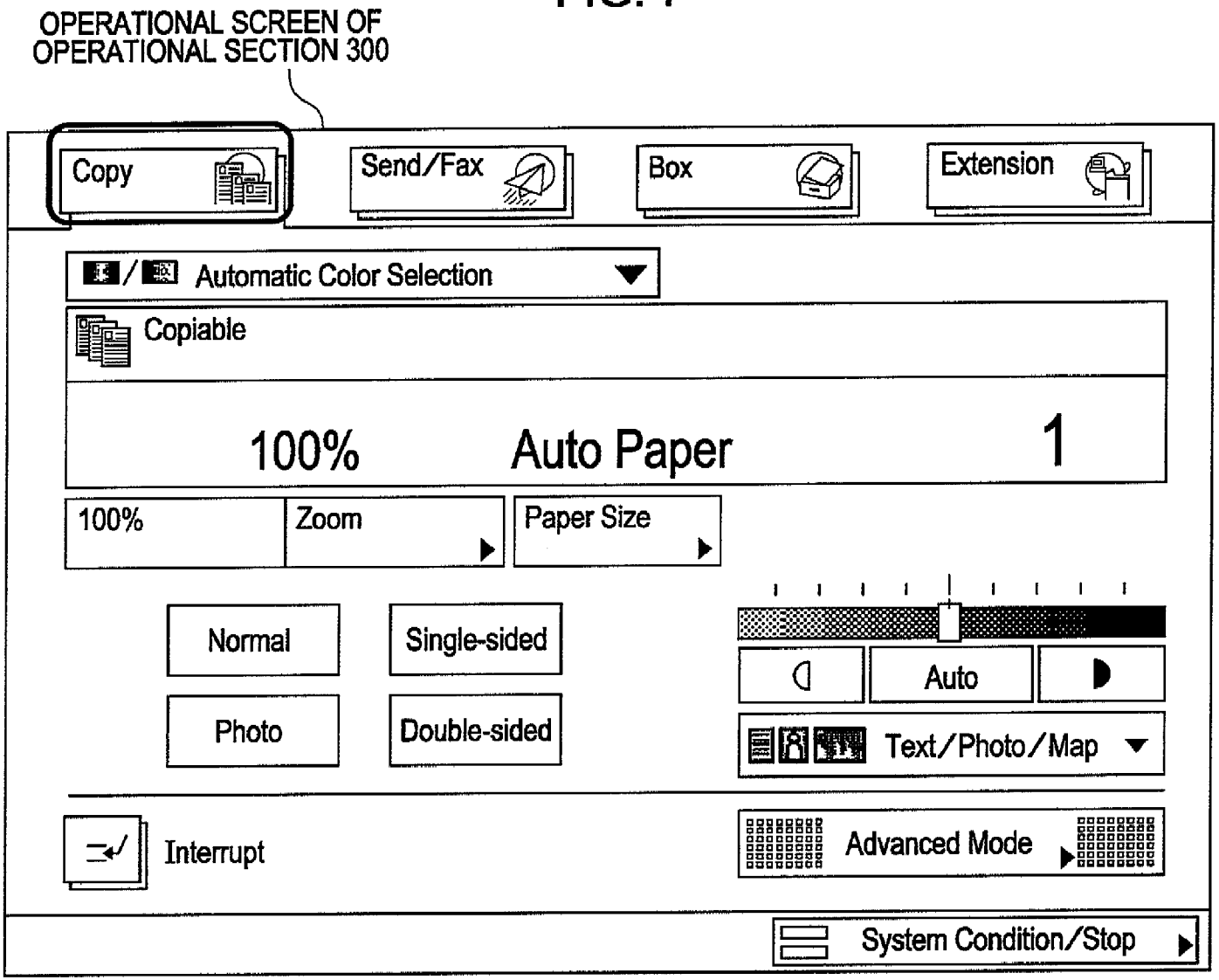
FIG. 7 is a representation of an operational screen of an operational section.
Figure 8:
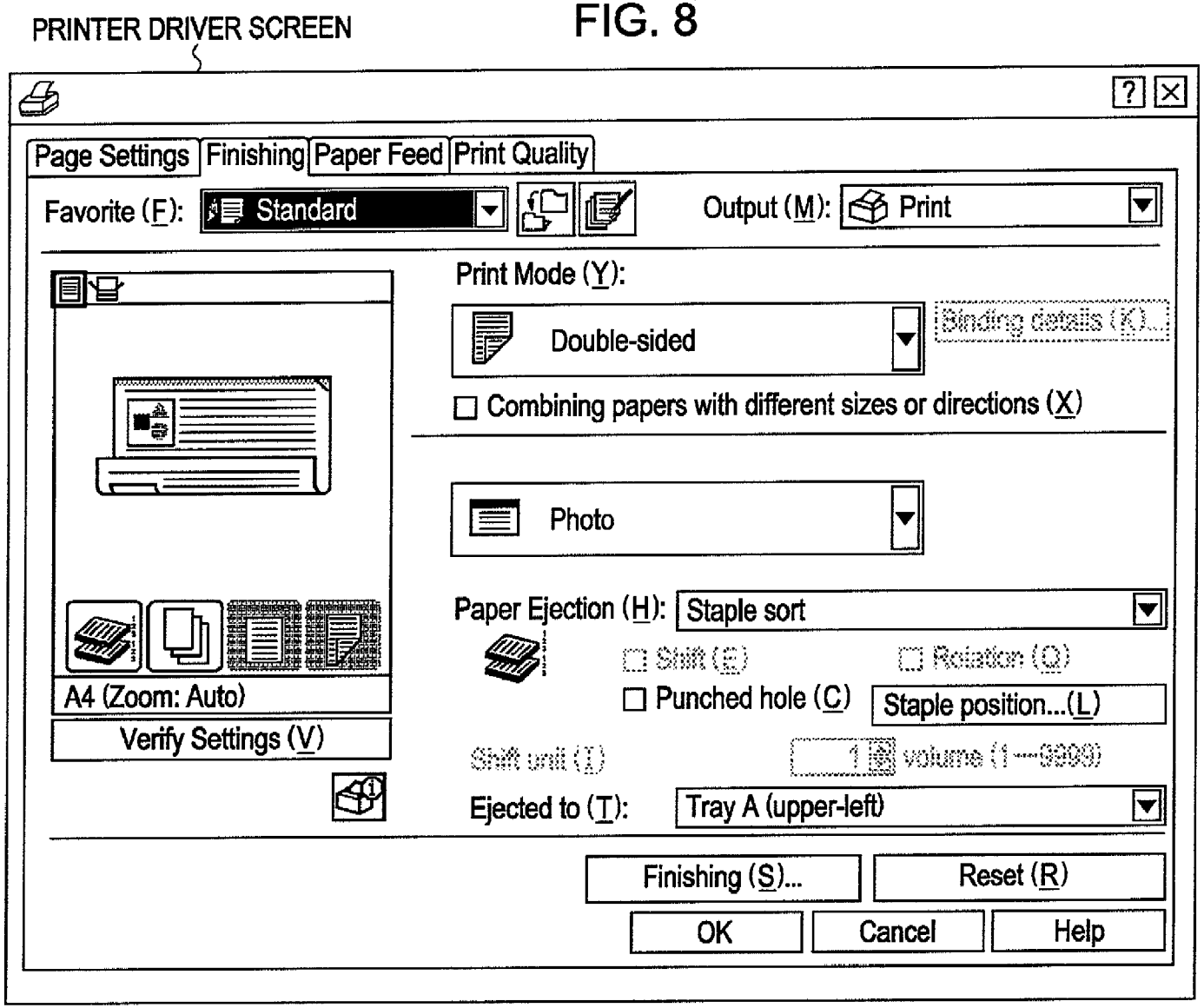
FIG. 8 is a representation of a printer driver screen of the external apparatus.

The controller 400 is also connected to the operational section, or a liquid crystal display as shown in FIG. 7. Hence, the controller 400 receives setting data or directions (printing command or the designation of the image-forming mode) inputted by the operator through the operational section, and controls the above devices according to the inputted information.

For example, the operational screen shown in FIG. 7 includes a normal output mode key, a photo output mode key, a single-sided image-forming mode key, and a double-sided image-forming mode key. The operator arbitrarily selects or designates these keys, and then presses a "Copy" button (not shown), thereby performing a desired image-forming mode.

The operator can set the number of copies, the size of paper, the type of sort, and whether or not staples will be used, through the operational screen.

The controller 400 may receive setting data or directions (printing command or the designation of the image-forming mode) inputted by the operator from the external apparatus through the network I/F and control the above-devices.

For example, a printer driver screen as shown in FIG. 8 may be used. The printer driver screen includes a key for choosing the double-sided printing (double-sided image-forming mode) or the single-sided printing (single-sided image-forming mode) to set the printing manner. The printer driver screen also includes a key for setting the image output mode to choose whether the normal output mode or the photo output mode. The operator can arbitrarily select or designate these keys and subsequently click an OK key (lower portion of FIG. 8) to confirm the settings. After completing the settings, the operator clicks a Print Start key (not shown) to transmit image-forming signals to the network I/F from the external apparatus, thus performing a desired image-forming mode.

The operator can set the number of copies, the size of paper, the type of sort, and whether or not staples will be used, through the printer driver screen.

Recording Material-Conveying Mechanism in Single-Sided Image-Forming Modes

The mechanism for conveying the recording material in the two single-sided image-forming modes will now be described.

Figure 5:
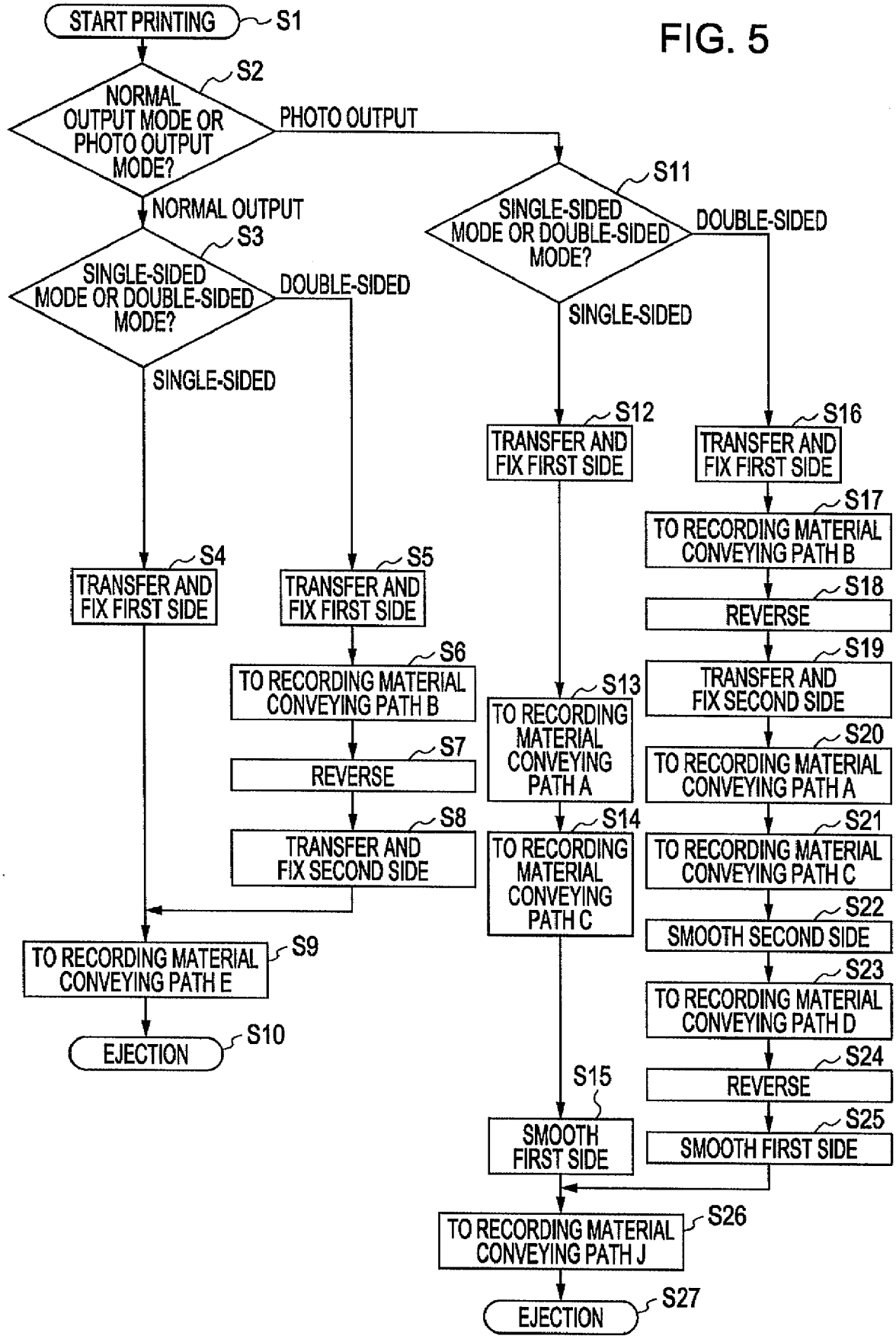
FIG. 5 is a flow diagram of an image-forming process.

The normal single-sided image-forming mode using plain paper or the like (one of the normal output modes) will first be described with reference to the flow diagram shown in FIG. 5, which shows a control flow of the controller 400 in FIG. 6.

On receiving a print start signal (S1), the controller 400 determines whether or not the current image-forming mode is the normal output mode (S2).

If the normal output mode has been designated in step S2, the controller 400 further determines whether or not the single-sided image-forming mode has been designated (S3). If the single-sided image-forming mode has been designated in step S3, the normal single-sided image-forming mode is performed.

In the normal single-sided image-forming mode, a recording material held in the cassette 100 is conveyed to the second transfer section by a plurality of conveying roller pairs 102. The recording material onto which toner images have been transferred in the second transfer section is conveyed to the fixing device 10 to fix the toner images (S4).

Then, the recording material is conducted to recording material conveying path A by a flapper 31 for switching the recording material conveying path, subsequently conducted to recording material conveying path E (S9), and thus ejected to the outside (S10). The recording material conveying path E has a plurality of conveying roller pairs 103, as shown in FIG. 1.

Figure 2A:
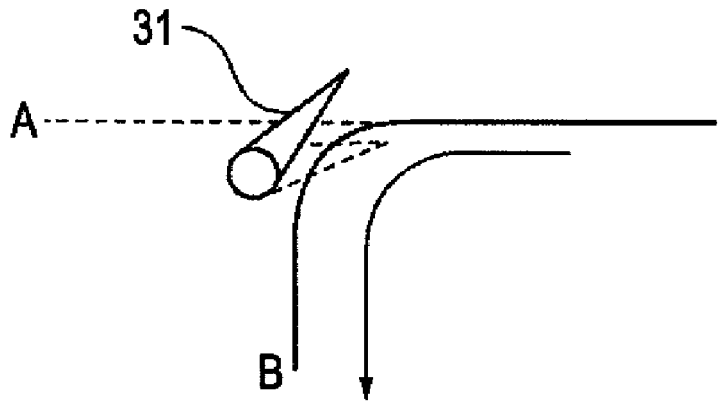
FIGS. 2A and 2B are schematic representations of the operation of a flapper.
Figure 2B:
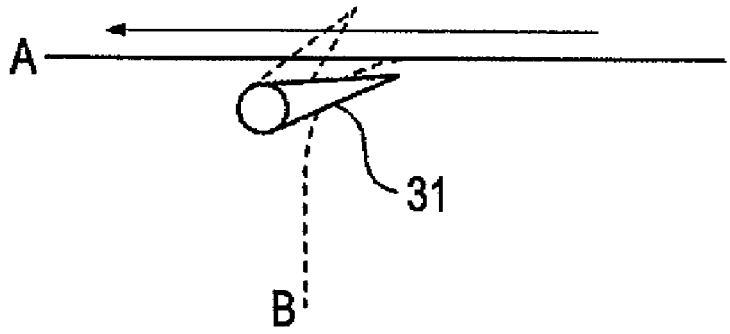

The mechanism of the flapper 31 will now be described with reference to FIGS. 2A and 2B. Other flappers 32 and 33 described later also have the same mechanism as the flapper 31 and the same description will not be repeated.

The flapper 31 includes a rotation axis and a blade that can rotate on the rotation axis. The flapper 31 introduces the recording material into either recording material conveying path A running in the direction from the right to the left of the figure or recording material conveying path B running downward in the figure. More specifically, when the flapper 31 is in the position shown in FIG. 2A, the recording material is directed downward to recording material conveying path B; when the flapper 31 is in the position shown in FIG. 2B, the recording material is directed leftward to the recording material conveying path A.

The rotation axis of the flapper 31 is connected to the drive motor, and the direction (position) of the blade of the flapper 31 is controlled by the controller controlling the rotation direction of the drive motor.

Another recording material conveying path may be provided in addition to the above recording material conveying paths A and B. In this instance, the flapper 31 distributes the recording material to three directions.

Next, the other single-sided image-forming mode specialized for the single-sided resin medium (one of the photo output modes) will now be described with reference to the flow diagram shown in FIG. 5.

If the controller 400 determines that the photo output mode has been designated in step S2, the controller 400 determines whether or not the single-sided image-forming mode has been designated (S11).

If the single-sided image-forming mode has been designated, the above-mentioned special single-sided image-forming mode is performed.

In the special single-sided image-forming mode, a single-sided resin medium held in the cassette 100 is conveyed to the second transfer section by the plurality of conveying pairs 102. The single-sided resin medium onto which the toner image has been transferred in the second transfer section is conveyed to the fixing device 10 to provisionally fix the toner image (S12). At this moment, the imaging surface of the single-sided resin medium is in the state shown in FIG. 4A.

Then, the single-sided resin medium is conducted to recording material conveying path A by the flapper 31 (S13). The recording material conveying path A is provided with a conveying roller pair 27 conveying the recording material to the smoothing unit 20, as shown in FIG. 1.

Figure 4B:
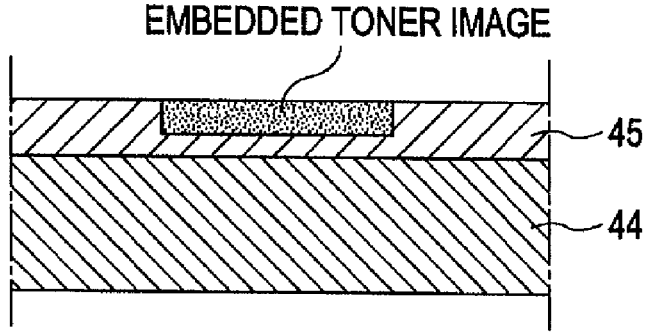

The single-sided resin medium is thus conducted to the smoothing unit through recording material conveying path C by the flapper 33 (S14). The recording material conveying path C is provided with a conveying roller pair. The smoothing unit embeds the toner image in the toner reception layer, thereby smoothing the imaging surface of the single-sided resin medium (FIG. 4B). The smoothed single-sided resin medium is conducted to recording material conveying path J by the flapper 32 for switching the recording material conveying path (S26) and is thus ejected to the outside (S27).

Double-Sided Image-Forming Mode

The image-forming apparatus of the present embodiment also has two double-sided image-forming modes for forming toner images on both sides of recording materials. The operator can choose either of these two modes in the same manner as in the single-sided image-forming modes, using the operational section of the image-forming apparatus. If the image-forming apparatus is used as a printer, such operation can be performed through an external apparatus networked with the image-forming apparatus.

One of the double-sided-image-forming modes is a normal mode, or first double-sided image-forming mode (one of the normal output modes). In this mode, toner images are formed on one side (first side) of a recording material, such as plain paper, and are subsequently fixed by the fixing device 10. Then, other toner images are formed and fixed onto the other side (second side) of the recording material, and the resulting recording material is ejected.

The other is a special mode, or second double-sided image-forming mode (one of the photo output modes). In this mode, toner images are formed and fixed onto both sides of a double-sided resin medium one by one, and the double-sided resin medium is ejected after smoothing the imaging surfaces of the resin medium.

More specifically, toner images are formed on one side (first side) of the double-sided resin medium and are fixed by the fixing device 10. Subsequently, other toner images are formed on the other side (second side) of the double-sided resin medium and are fixed by the fixing device 10. Then, the double-sided resin medium is introduced into the smoothing unit to smooth both imaging surfaces of the double-sided resin medium, and is finally ejected. In the photo output mode, the toner images onto the toner reception layers described above are fixed to the extent that the toner will not be offset to the conveying rollers or the like during conveying the double-sided resin medium. In other words, such fixing may be referred to as "provisional fixing" and is different in fixing conditions and fixing results from the fixing performed in the normal double-sided image-forming mode.

Recording Material-Conveying Mechanism in Double-Sided Image-Forming Modes

The mechanism for conveying the recording material in the two double-sided image-forming modes will now be described.

The normal first double-sided image-forming mode using plain paper or the like (one of the normal output modes) will first be described.

On receiving a print start signal (S1), the controller 400 determines whether or not the current image-forming mode is the normal output mode (S2).

If the normal output mode has been designated, the controller determines whether or not the single-sided image-forming mode has been designated (S3). If the double-sided image-forming mode, but not the single-sided image-forming mode, has been designated, the above-described normal double-sided image-forming mode is performed. In the normal double-sided image-forming mode, a recording material held in the cassette 100 is conveyed to the secondary transfer section by the plurality of conveying roller pairs 102. The recording material to whose first side toner images have been transferred in the secondary transfer section is conveyed to the fixing device 10 to fix the toner images (S5).

Then, the recording material is conducted to recording material conveying path B by the flapper 31 (S6). The recording material is turned upside down in the recording material conveying path B (S7) and is conducted to the secondary transfer section again. The recording material conveying path B is provided with a plurality of conveying roller pairs 104 including a reversing roller for switchbacking the recording material to turn it upside down, as shown in FIG. 1.

The recording material onto whose second side toner images have been transferred in the secondary transfer section is conveyed to the fixing device 10 to fix the toner images on the second side (S8). The resulting recording material is conducted to recording material conveying path A by the flapper 31. Then, the recording material is conducted to recording material conveying path E by the flapper 33 (S9) and thus ejected to the outside (S10).

Next, the other double-sided image-forming mode (one of the photo output modes), or the second double-sided image-forming mode specialized for the double-sided resin medium, will now be described.

On receiving a print start signal (S1), the controller 400 determines whether or not the current image-forming mode is the normal output mode (S2).

If the photo output mode, and not the normal output mode, has been designated in step S2, the controller 400 further determines whether or not the single-sided image-forming mode has been designated (S11). If the double-sided image-forming mode, and not the single-sided image-forming mode, has been designated in step S11, the special double-sided image-forming mode is performed.

In the special double-sided image-forming mode, a double-sided resin medium held in the cassette 100 is conveyed to the secondary transfer section by the plurality of conveying roller pairs 102 in the same manner as described above. The double-sided resin medium onto whose first side toner images have been transferred in the secondary transfer section is conveyed to the fixing device 10 to provisionally fix the toner images to the first side (S16).

Then, the double-sided resin medium is conducted to recording material conveying path B by the flapper 31 (S17). The double-sided resin medium is turned upside down in the recording material conveying path B (S18), and conveyed to the secondary transfer section again.

The double-sided resin medium onto whose second side toner images have been transferred in the secondary transfer section is conveyed to the fixing device 10 to provisionally fix the toner images on the second side (S19).

Subsequently, the double-sided resin medium is directly conveyed to recording material conveying path A by the flapper 31 without being introduced to recording material conveying path B where the resin medium is turned upside down (S20). The double-sided resin medium is then introduced into the smoothing unit 20 through recording material conveying path C by the flapper 33 (S21). In the smoothing unit 20, the second side of the double-sided resin medium is smoothed (S22).

Subsequently, the double-sided resin medium whose second side has been smoothed is conducted to recording material conveying path D by the flapper 32 (S23). The resin medium is turned upside down in the recording material conveying path D (S24) and is conveyed to the smoothing unit 20 (conveying roller pair 27) again. The recording material conveying path D is provided with a plurality of conveying roller pairs 105 including a reversing roller for turning the recording material upside down, as shown in FIG. 1.

In the smoothing unit 20, the first side of the double-sided resin medium is smoothed (S25).

The double-sided resin medium whose imaging surfaces have been smoothed is conducted to recording material conveying path J by the flapper 32 (S26) and thus ejected to the outside (S27).

In summary, the special double-sided image-forming mode treats the double-sided resin medium by fixing the first side, fixing the second side, smoothing the second side, and smoothing the first side in that order. The double-sided resin medium is thus ejected to the outside.

Smoothing Conditions of Double-Sided Resin Medium in Double-Sided Image-Forming Mode Smoothing conditions of the double-sided resin medium in the double-sided image-forming mode will now be described.

According to an embodiment, for forming images on the double-sided resin medium, the first and the second side are smoothed under different conditions (including at least one of smoothing speed, pressure, and heating temperature) and the conditions are switched for the first and the second side.

In the description, the first side of the double-sided resin medium refers to the imaging surface on which toner images are previously transferred, but not the imaging surface that is smoothed first.

The inventors of the present invention found that the already smoothed second side of a double-sided resin medium is negatively affected by the smoothing of the first side to degrade the glossiness. The already smoothed second side of the double-sided resin medium has been subjected to heat and pressure, and accordingly it does not require heat or pressure during the smoothing of the first side.

In an embodiment, accordingly, the first side toner reception layer 45A of the double-sided resin medium has a lower glass transition temperature (for example 50° C.) than the glass transition temperature (for example 60° C.) of the second side toner reception layer 45B. In other words, the toner reception layer 45B that is to be previously smoothed has a higher glass transition temperature (for example 60° C.) than the glass transition temperature (for example 50° C.) of the toner reception layer 45A that is to be subsequently smoothed. In this instance, the toner reception layers 45A and 45B each have a glass transition temperature Tg in the range of 40 to 80° C.

In addition, the first side toner reception layer 45A is smoothed at a speed (peripheral speed of the belt 23) higher than the smoothing speed of the second side toner reception layer 45B. In other words, the subsequently smoothed toner reception layer 45A (Tg=50° C.) is smoothed at a speed higher than the smoothing speed of the previously smoothed toner reception layer 45B (Tg=60° C.). For example, the first side toner reception layer 45A is smoothed at a speed of 80 mm/s and the second side toner reception layer 45B is smoothed at a speed of 50 mm/s.

The smoothing unit is set so that the same temperature and the same pressure are applied to the first side toner reception layer 45A and the second side toner reception layer 45B for smoothing.

An example and a comparative example were performed to evaluate the above-described smoothing conditions and the results are shown in Table 3. In the comparative example, the first side toner reception layer 45A and the second side toner reception layer 45B were smoothed under all the same conditions (smoothing speed: 50 mm/s).

TABLE 3

| When was | Example | | Comparative Example | |
|---|---|---|---|---|
| glossiness measured? | Smoothed side | Glossiness | Smoothed side | Glossiness |
| Immediately after fixing 2nd side | 1st side | 20 | 1st side | 20 |
| | 2nd side | 20 | 2nd side | 20 |
| Immediately after smoothing 2nd side | 1st side | 40 | 1st side | 40 |
| | 2nd side | 90 | 2nd side | 90 |
| Immediately after smoothing 1st side | 1st side | 90 | 1st side | 90 |
| | 2nd side | 85 | 2nd side | 60 |

As clearly shown in Table 3, the glossiness of the second side in the example was slightly reduced but was as sufficient as 85. This is because in the example, the first side was smoothed in such a manner that the second side would not be softened or melted. Hence, according to the present embodiment, both the imaging surfaces of the double-sided resin medium can exhibit satisfying glossiness.

In contrast, the glossiness of the second side in the comparative example was reduced to 60. This is because in the comparative example, the smoothing speed was not changed and consequently the second side was softened and melted during the smoothing of the first side. Hence, in the comparative example, the first side of the double-sided resin medium exhibited a satisfying glossiness, but the glossiness of the second side was not satisfactory.

Thus, an embodiment can smooth both imaging surfaces of the double-sided resin medium, and hence form glossy images on both sides of the double-sided resin medium.

While the double-sided resin medium has a first side toner reception layer having a glass transition temperature Tg of 50° C. and a second toner reception layer having a glass transition temperature Tg of 60° C. in the above-described embodiment, the glass transition temperatures Tg are not limited to those values.

Note again that the first side of the double-sided resin medium refers to the surface onto which toner images are previously transferred, and that the smoothing of this side is performed in a step subsequent to the smoothing of the second side.

The present inventors confirmed the above and the results are shown in Table 4. Tests were performed at a smoothing speed of 80 mm/s for the first side toner reception layer 45A and at a smoothing speed of 50 mm/s for the second toner reception layer 45B. The heating temperature and the pressure of the smoothing unit 20 were the same as in the above Example regardless of the side to be smoothed.

TABLE 4

| Difference in Tg between 1st side and 2nd side | Difference in glossiness between 1st side and 2nd side | Evaluation |
|---|---|---|
| 0 | 40 | Bad |
| 5 | 15 | Fair |
| 10 | 5 | Good |
| 15 | 5 | Good |
| 20 | 3 | Good |
| 25 | 0 | Excellent |
| 30 | 0 | Excellent |

As shown in Table 4, when the difference in glass transition temperature between the first side and the second side of the double-sided resin medium was 0° C., the difference in glossiness between the first side and the second side was 40 and the image quality was degraded.

When the difference in glass transition temperature between the first side and the second side was 5° C., the difference in glossiness in the first side and the second side was 15 and the image quality was reduced, but to the extent that can be acceptable in practice.

When the difference in glass transition temperature between the first side and the second side was 10° C. or more, high quality images were obtained.

The results above suggest that it is preferable that the glass transition temperatures of the first and second sides of the double-sided resin medium be set in the range of 40 to 80° C. with a difference of at least 5° C.

In order to achieve high-quality images on both imaging surfaces, it is preferable that the glass transition temperatures of the first and second sides of the double-sided resin medium be set in the range of 40 to 80° C. with a difference of at least 10° C.

Second Embodiment

An image-forming apparatus shown in FIG. 9 according to a second embodiment will now be described. The image-forming apparatus according to the second embodiment uses a transfer belt that can convey the recording material, but other components or members are the same as in the first embodiment. The same points are not repeated in the description.

In other words, the second embodiment is also the same in that images may be formed on both sides of a double-sided resin medium.

In the present embodiment, the recording material is conveyed different route from the first embodiment. The following description will illustrate the single-sided image-forming modes and double-sided image-forming modes using a recording material such as plain paper or a double-sided resin medium.

In the image-forming apparatus of the present embodiment, the same image-forming stations Y, M, C, and K as in the first embodiment are aligned in the vertical direction.

A transfer belt 76 that can convey the recording material is rotatably disposed so as to come in contact with the photosensitive drum of each image-forming station.

The transfer belt 76 traverses a drive roller 77, a tension roller 79, and a follower roller 78 and is rotated clockwise in FIG. 4 by receiving a force from the drive roller 77.

The recording material held in the cassette 100 is conveyed to the resist roller pair 8. The resist roller pair 8 sends the recording material to the transfer belt 76 in synchronization with the movement of the photosensitive drums on which a toner image has been formed.

The recording material from the resist roller pair 8 is electrostatically adsorbed to the transfer belt 76, and transfer areas of the image-forming stations are transferred one after another.

In transfer section, a transfer bias voltage is applied to transfer rollers 75Y to 75K, so that the respective color toner images are transferred onto the recording material so as to overlap one another, thus forming a color image. Then, the resulting recording material is conveyed to the fixing device 10 and ejected to the outside. For use of a resin medium, the resin medium is conveyed to the fixing device 10 and ejected through the smoothing unit 20.

Figure 10:
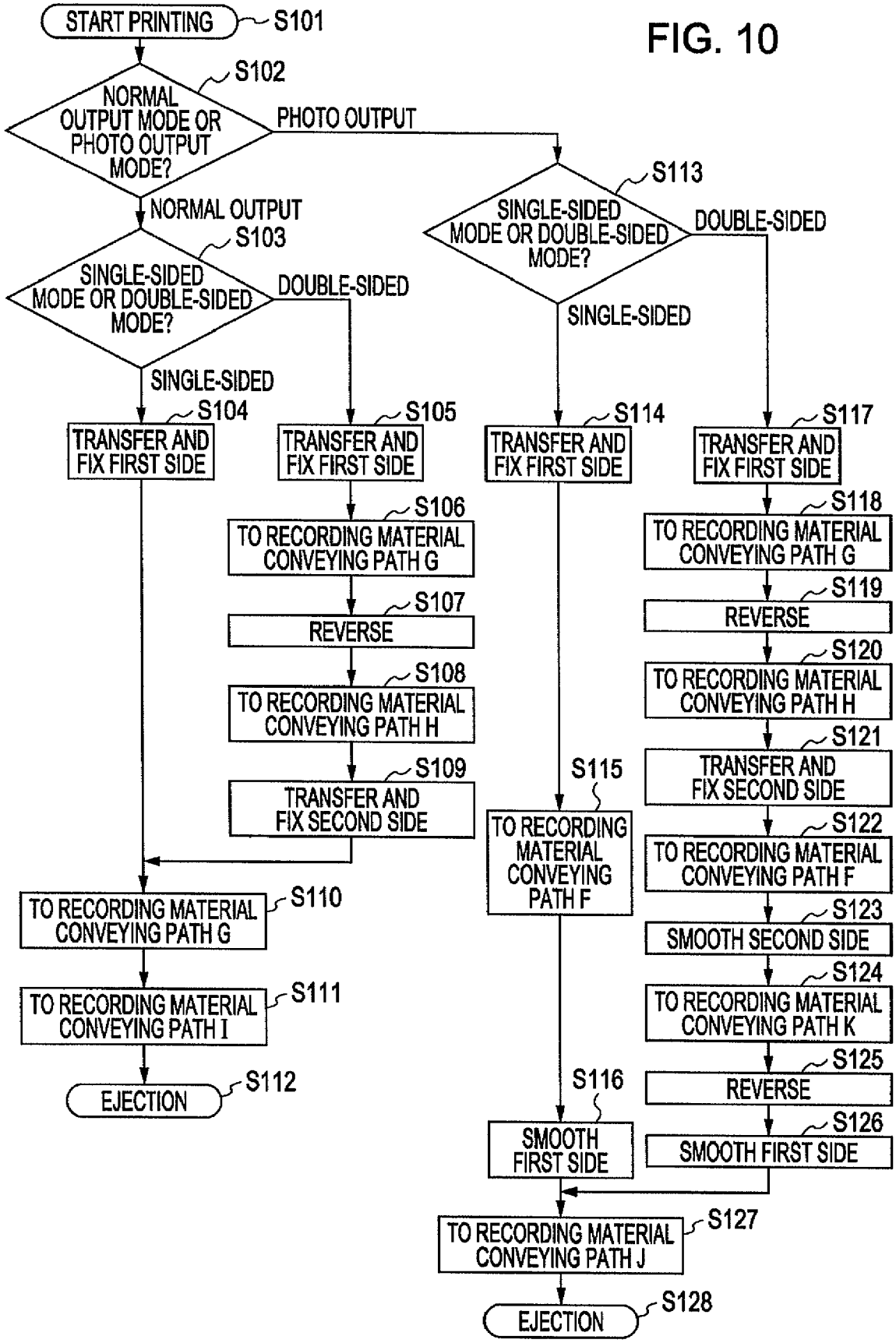
FIG. 10 is a flow diagram of an image-forming process of the image-forming apparatus shown in FIG. 9.

The single-sided image-forming modes will now be described with reference to the flow diagram shown in FIG. 10. FIG. 10 is a flow diagram through which the controller 400 controls the apparatus.

Single-Sided Image-Forming Mode

The image-forming apparatus of the present embodiment has two single-sided image-forming modes: a first single-sided image-forming mode for normal media such as plain paper; and a second single-sided image-forming mode for a special medium such as a single-sided resin medium.

First, the normal mode or the first single-sided image-forming mode will be described.

On receiving a print start signal (S101), the controller 400 determines whether or not the current image-forming mode is the normal output mode (S102).

If the normal output mode has been designated, the controller 400 further determines whether or not the single-sided image-forming mode (S103) has been designated. If the single-sided image-forming mode has been designated, the normal single-sided image-forming mode is performed. In the normal single-sided image-forming mode, a recording material held in the cassette 100 is conveyed to the resist roller pair 8 by pickup rollers 101 and then to the transfer belt 76 by the resist roller pair 8.

The recording material conveyed to the transfer belt 76 is subjected to transfer of the toner images of the image-forming stations whenever the recording material passes by the transfer areas, and is subsequently self-stripped from the transfer belt 76. The recording material onto which the toner images have been transferred is conveyed to the fixing device 10 to fix the toner images (S104).

Then, the recording material is conducted to recording material conveying path G by a flapper 34 for switching the recording material conveying path (S110). Subsequently, the recording material is conducted to recording material conveying path I by another flapper 35 for switching the recording material conveying path (S111) and thus ejected to the outside (S112). The recording material conveying paths G and I have conveying roller pairs, as shown in FIG. 9.

Next, the special single-sided image-forming mode will be described with reference to FIG. 10.

On receiving a print start signal (S101), the controller 400 determines whether or not the current image-forming mode is the normal output mode (S102).

If the photo output mode, but not the normal output mode, has been designated, the controller further determines whether or not the single-sided image-forming mode has been designated (S113). If the single-sided image-forming mode has been designated, the special single-sided image-forming mode is performed.

In the special single-sided image-forming mode, a single-sided resin medium held in the cassette 100 is conveyed to the resist roller pair 8 by the pickup rollers 101 and subsequently conveyed to the transfer belt 76 by the resist roller pair 8.

The single-sided resin medium conveyed to the transfer belt 76 is subjected to transfer of the toner images of the image-forming stations whenever the resin medium passes by the transfer areas, and is subsequently self-stripped from the transfer belt 76. The single-sided resin medium onto which the toner images have been transferred is conveyed to the fixing device 10 to fix the toner images (S114).

Then, the single-sided resin medium is conducted to the smoothing unit 20 through recording material conveying path F by the flapper 34 (S115). The recording material conveying path F is provided with a conveying roller pair 27.

Thus the single-sided resin medium is smoothed in the smoothing unit 20 (S116). Subsequently, the single-sided resin medium is conducted to recording material conveying path J by a flapper 36 for switching the recording material conveying path (S127) and thus ejected to the outside (S128). The recording material conveying path J is provided with a conveying roller pair as shown in FIG. 9.

The double-side image-forming mode will now be described.

Double-Sided Image-Forming Mode

The image-forming apparatus of the present embodiment, as well as that of the first embodiment, has two double-sided image-forming modes: a first double-side image-forming mode for normal media such as plain paper; and a second double-sided image-forming mode for a special medium such as a double-sided resin medium.

First, the normal mode or the first double-sided image-forming mode will be described.

On receiving a print start signal (S101), the controller 400 is determines whether or not the current image-forming mode is the normal output mode (S102).

If the normal output mode has been designated, the controller 400 further determines whether the single-sided image-forming mode has been designated (S103). If the double-sided image-forming mode, but not the single-sided image-forming mode, has been designated, the normal double-side image-forming mode is performed.

In the normal double-side image-forming mode, a recording material held in the cassette 100 is conveyed to the resist roller pair 8 by the pickup rollers 101 and subsequently to the transfer belt 76 by the resist roller pair 8.

The recording material conveyed to the transfer belt 76 is subjected to transfer of the toner images of the image-forming stations onto a first side thereof when the recording material passes by the transfer areas, and is subsequently self-stripped from the transfer belt 76. The recording material onto which the toner images have been transferred is conveyed to the fixing device 10 to fix the toner images on the first side (S105).

Then, the recording material is conveyed to recording material conveying path G by the flapper 34 (S106), and subsequently to recording material conveying path H by the flapper 35 for switching the recording material conveying path (S107). At this point, the recording material is turned upside down in the entrance of the recording material conveying path H (brunch point of the recording material conveying path) (S108). The recording material conveying path H is provided with a plurality of conveying roller pairs including a reversing roller for switchbacking the recording material to turn it upside down, as shown in FIG. 9.

The recording material is conveyed to the transfer belt 76 again through recording material conveying path H, so that a toner image is transferred onto the other side, or the second side, and then conveyed to the fixing device 10.

The recording material onto whose second side the toner image has been transferred is subjected to fixing in the fixing device 10 (S109) and subsequently conducted to recording material conveying path G by the flapper 34 (S110). The recording material is further conducted to recording material conveying path I by the flapper 35 (S111) and thus ejected to the outside (S112).

Next, the special double-side image-forming mode will be described.

On receiving a print start signal (S101), the controller 400 determines whether or not the current image-forming mode is the normal output mode (S102).

If the photo output mode, but not the normal output mode, has been designated, the controller 400 further determines whether or not the single-sided image-forming mode has been designated (S113). If the double-side image-forming mode, but not the single-sided image-forming mode, has been designated, the special double-sided image-forming mode is performed.

In the special double-sided image-forming mode, a double-sided resin medium is conveyed to the resist roller pair 8 by the pickup rollers 101 in the same manner as described above, and subsequently to the transfer belt 76 by the resist roller pair 8.

The double-sided resin medium conveyed to the transfer belt 76 is subjected to transfer of toner images of the transfer areas onto a first side thereof whenever the resin medium passes by the transfer sections, and is subsequently self-stripped from the transfer belt 76. The double-sided resin medium onto whose first side toner images have been transferred is conveyed to the fixing device 10 to fix the toner images on the first side (S117).

Then, the double-sided resin medium is conducted to recording material conveying path G by the flapper 34 (S118), and subsequently to recording material conveying path H by the flapper 35 (S120). At this point, the recording material is turned upside down at the entrance of the recording material conveying path H (brunch point of the recording material conveying path) (S119).

The double-sided resin medium is conveyed to the transfer belt 76 again through the recording material conveying path H, so that other toner images are transferred onto the other side, or the second side, of the double-sided resin medium, and then conveyed to the fixing device 10. The double-sided resin medium onto whose second side the toner images have been transferred is subjected to provisional fixing by the fixing device 10 (S121).

The resulting double-sided resin medium is immediately introduced to recording material conveying path F and thus conducted to the smoothing unit 20 by the flapper 34 (S122), without being conveyed to the recording material conveying path H in which the resin medium is turned upside down. The smoothing unit 20 smooths the second side of the double-sided resin medium (S123).

Then, the double-sided resin medium whose second side has been smoothed is conducted to recording material conveying path K by the flapper 36 (S124). The resin medium is turned upside down in the recording material conveying path K (S125) and is subsequently conveyed to the smoothing unit 20 (conveying roller pair 27) again. The recording material conveying path K is provided with a plurality of conveying roller pairs including a reversing roller for turning the recording material upside sown, as shown in FIG. 9.

The double-sided resin medium whose first side has been smoothed in the smoothing unit 20 (S126), that is, the double-sided resin medium subjected to smoothing at both imaging surfaces, is conducted to recording material conveying path J by the flapper 36 (S127) and is ejected to the outside (S128).

In summary, the special double-sided image-forming mode treats the double-sided resin medium by fixing the first side, fixing the second side, smoothing the second side, and smoothing the first side in that order. The double-sided resin medium is thus ejected to the outside.

The flappers 34 to 36 have the same structure as the flappers 31 to 33 of the first embodiment, and the detailed description is omitted.

As described above, the image-forming apparatus of the second embodiment using the transfer belt 76 that can convey the recording material can form glossy images at both side of a double-sided resin medium, thus producing the same effect as that of the first embodiment.

Third Embodiment

While the third embodiment uses a different double-sided resin medium from the first embodiment, the other points are the same as in the first embodiment. The same descriptions are not repeated.

The double-sided resin medium used in the present embodiment has imaging surfaces exhibiting different properties from each other. Therefore, if the operator incorrectly sets the double-sided resin medium upside down in the image-forming apparatus, the resulting glossiness at both imaging surfaces may not be satisfactory and thus the double-sided resin medium results in waste.

Figure 11:
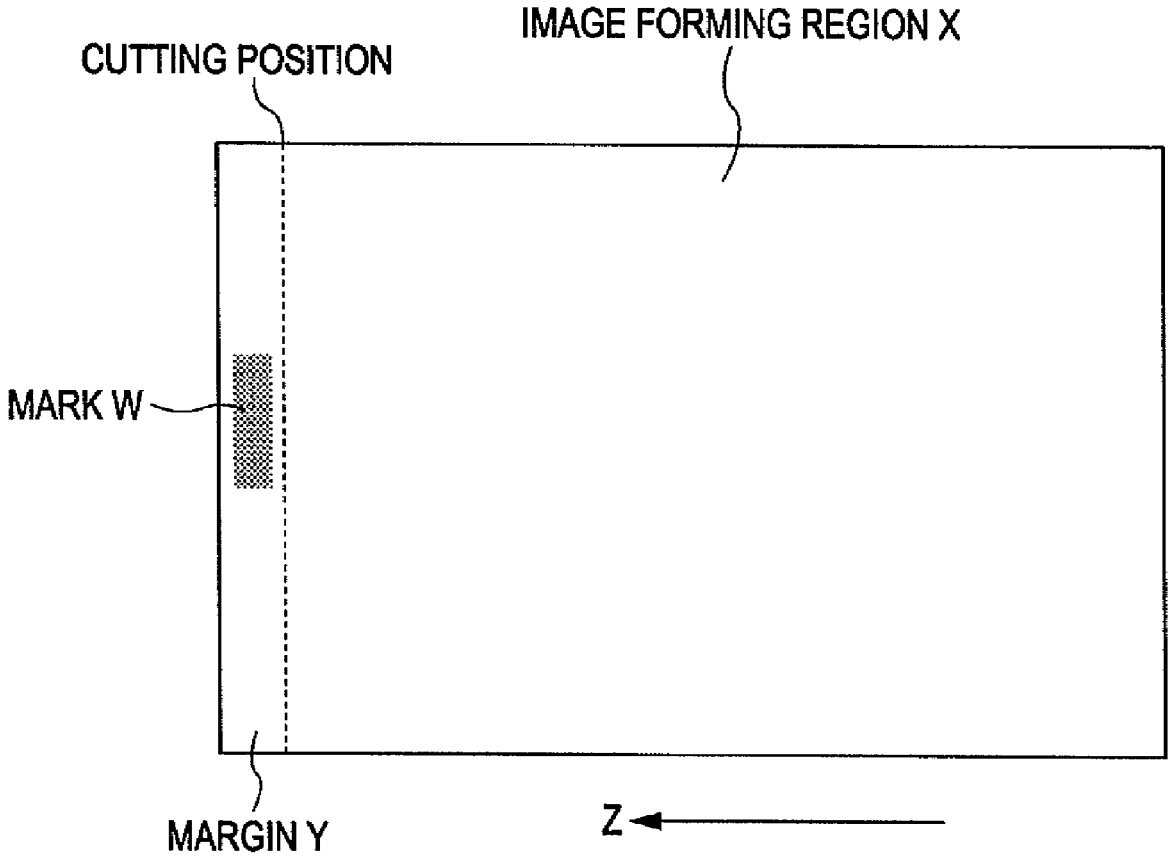
FIG. 11 is a representation of a front/back discrimination mark provided on a double-sided resin medium.

Accordingly, the double-sided resin medium is provided with a front/back discrimination mark W (determination point) at a specific point, as shown in FIG. 11. The arrow Z shown in FIG. 11 is the direction in which the medium is conveyed.

More specifically, a mark W having a different glossiness from the image forming region X of the double-sided resin medium is provided in the outside of the image forming region X, that is, in the so-called margin Y. This mark W is formed by roughening the surface of the toner reception layer 45 after forming it. The mark W finally has the same smoothness, that is, the same glossiness, as those of the image forming region X by smoothing. Thus, the mark W on the resulting product is indistinctive. Different font/back discrimination marks may be provided on the respective sides of the double-sided resin medium, or a mark may be provided on one side.

In an embodiment, a first side discrimination mark W is provided in the margin of a first side of the double-sided resin medium (side onto which toner images are previously transferred), and no marks is provided on the other side, or the second side. The side having no mark can thus be identified as the second side.

By providing such a front/back discrimination mark to the double-sided resin medium, the operator can set the double-sided resin medium correctly without setting the medium upside down in the image-forming apparatus.

As the operator selects or designates the double-side image-forming mode using the double-sided resin medium, the operator is instructed to place the double-sided resin medium in such a manner that the marked side is facedown in the cassette 100. More specifically, on designating the double-side image-forming mode using the double-sided resin medium, the controller 400 directs the operational section to indicate a message for guiding the set position of the double-sided resin medium.

Even if the mark W is provided, the double-sided resin medium may be incorrectly set. In the present embodiment, a front/back discrimination sensor 500 is provided as a detector for detecting the mark.

Figure 12:
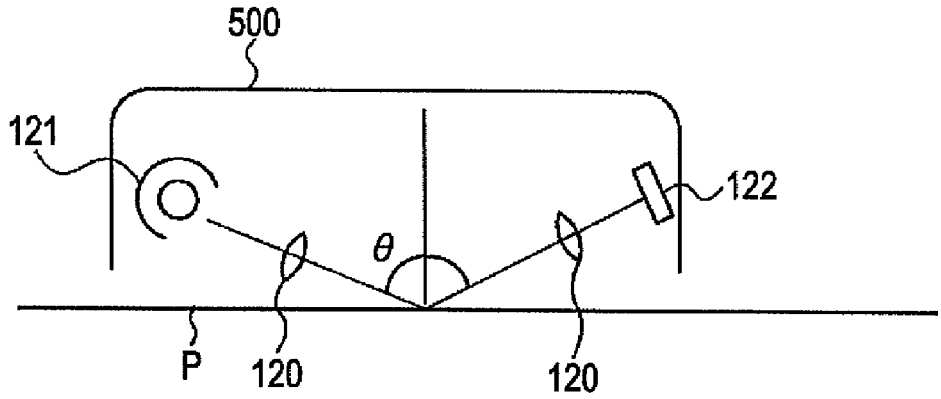
FIG. 12 is a schematic sectional view of a sensor that detects the front/back discrimination mark on a double-sided resin medium.

FIG. 12 is a schematic diagram of the front/back discrimination sensor 500, disposed in a recording material conveying path using a plurality of conveying roller pairs 102 (FIG. 1). The sensor 500 detects the glossiness of the surface of the resin medium.

Specifically, the sensor 500 includes a light emitting portion 121 that emits light beam to the surface of a resin medium at an incident angle θ and a photo detector 122 that receives the light beam regularly reflected from the surface of the resin medium at a specific angle.

As shown in FIG. 11, the light beam emitted from the light emitting portion 121 runs through lenses 120 and enters the resin medium at an incident angle θ. The photo detector 122 detects the light beam regularly reflecting from the resin medium through the lens 120.

If the sensor 500 detects the mark W, the controller 400 connected to the sensor 500 discriminates between the sides of the resin medium according to a signal received from the sensor 500.

If the position of the resin medium is correct, the controller 400 allows continuous image forming without interruption.

If the position of the resin medium is incorrect, the controller 400 stops forming images and directs the operational section to indicate that the position of the resin medium is incorrect. In addition, the operational section indicates that a resin medium stopped on the recording material conveying path with the conveying roller pairs 102 (see FIG. 1) should be removed.

The sensor 500 may be disposed, for example, in the vicinity of the cassette 100 (FIG. 1) without limiting to the position described above. Such a position allows the side of the resin medium in the cassette to be discriminated before starting conveying the resin medium. Consequently, it becomes unnecessary to remove the resin medium.

In an embodiment, the mark W is provided in substantially the center in the widthwise direction of the resin medium (in the direction perpendicular to the conveying direction). If the mark W is provided at a side in the widthwise direction and a back end in the conveying direction, the sensor 500 cannot detect the mark W even if the resin medium correctly set.

Figure 13:
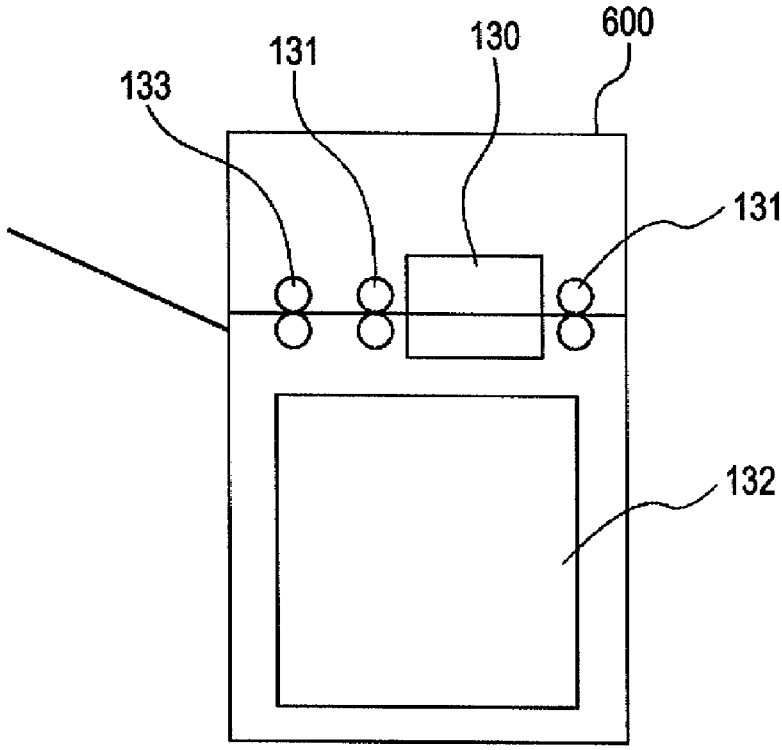
FIG. 13 is a schematic sectional view of a cutting apparatus that cuts resin media.

The image-forming apparatus of an embodiment includes a cutter unit 600 as shown in FIG. 13 that partially cuts the single-sided resin medium or the double-sided resin medium and that collects unnecessary portions of the resin medium. The cutter unit 600 can be optionally installed to an image-forming system including the smoothing unit according to the operator's needs.

For example, four images are formed on a single resin medium, and the resin medium is cut into four pieces by the cutter unit 600. In this instance, the margin is cut off and removed by the cutter 600.

FIG. 13 is a schematic sectional view of the cutter unit 600. The cutter unit 600 is disposed downstream from the smoothing unit 20 in the direction in which the recording material is conveyed; hence, the smoothing unit 20, not shown in FIG. 13, is located at the right side in FIG. 13.

More specifically, the cutter unit 600 includes a rotary cutter 130, a plurality of conveying roller pairs 131 for conveying the recording material, and a collector 132.

The rotary cutter 130 includes a rotary cutter portion for cutting the recording material along the conveying direction and another rotary cutter portion for cutting the recording material along the widthwise direction of the recording material (the direction perpendicular to the conveying direction).

The operational sequence of the cutter unit 600 will now be described. The operation of the cutter unit 600 is controlled by the controller 400.

As a double-sided resin medium whose imaging surfaces have been smoothed by the smoothing unit 20 is introduced to the cutter unit 600, the resin medium is stopped by the roller pairs 131 with the rotary cutter 130 therebetween.

Then, the rotary cutter 130 cuts the stopped double-sided resin medium into four pieces and cut off the margin Y.

The unnecessary margin Y drops into the collecting box 132 disposed at a lower position. When the collecting box 132 is filled with collected matter, the controller 400 directs the operational screen to indicate such a state, and instructs the operator to dispose of the collected matter. The timing of the indication is performed by the controller 400 counting the number of media cut by the cutter unit 600.

The resin medium cut into four pieces are ejected to the outside by a conveying roller pair 133, and a sequence of image forming is thus completed.

By forming four images on a single double-sided resin medium, the productivity of images can be increased. Also, by cutting off an unnecessary margin, the usability can be enhanced.

While the present embodiment illustrates a case using a double-sided resin medium, the cutter unit 600 can be operated in the same manner for a single-sided resin medium.

Figure 9:
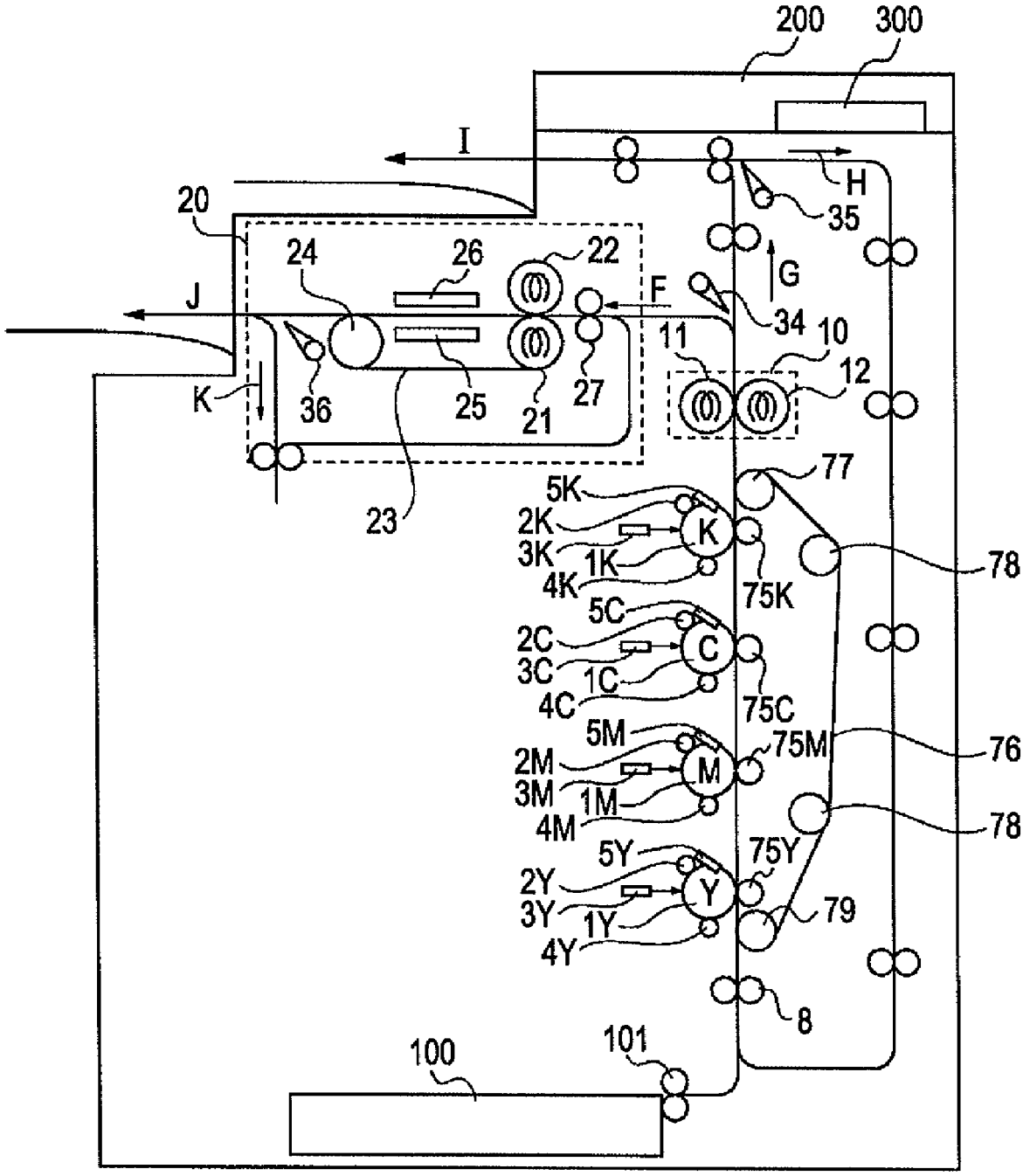
FIG. 9 is a schematic sectional view of an image-forming apparatus according to a second embodiment of the present invention.

The features of the third embodiment can be applied to the image-forming apparatus (image-forming system) shown in FIG. 9 as well as the image-forming apparatus (image-forming system) shown in FIG. 1.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2006-277727 filed Oct. 11, 2006, which is hereby incorporated by reference herein in its entirety.

What is claimed is:

1. A recording material having image-forming surfaces at both sides thereof on which toner images are capable of being formed and which are smoothed by heating and pressing, the recording material comprising:

a base; and toner reception layers disposed on both surfaces of the base, each toner reception layer having a glass transition temperature in a range of 40 to 80° C., wherein one of the toner reception layers has an at least 5° C. higher glass transition temperature than the other toner reception layer.

2. The recording material according to claim 1, wherein one of the toner reception layers has an at least 10° C. higher glass transition temperature than the other toner reception layer.

3. The recording material according to claim 1, further comprising a front/back discrimination portion with which front and back sides of the recording material are capable of being discriminated.

4. The recording material according to claim 1, wherein the base comprises a base paper.

5. The recording material according to claim 4, wherein the toner reception layers comprises a first toner reception layer formed of a polyester resin disposed on a first side of the base paper and a second toner reception layer formed of a polyester resin disposed on a second side of the base paper.

6. The recording material according to claim 5, further comprising:

a first resin layer formed of a polyethylene resin disposed between the first toner reception layer and the first side of the base paper; and a second resin layer formed of a polyethylene resin disposed between the second toner reception layer and the second side of the base paper.

7. The recording material according to claim 6, further comprising:

a first intermediate layer disposed between the first resin layer and the first toner reception layer; and a second intermediate layer disposed between the second resin layer and the second toner reception layer.

8. A smoothing system comprising:

a smoothing unit that smooths a recording material including toner reception layers at both sides on which toner images have been formed, by heating and pressing the toner reception layers, wherein the toner reception layers have glass transition temperatures in a range of 40 to 80° C. with a difference of at least 5° C. therebetween, and the smoothing unit smooths the toner reception layer having a higher glass transition temperature prior to the other toner reception layer.

9. The smoothing system according to claim 8, wherein the toner reception layer having a lower glass transition temperature is smoothed at a higher speed than the other toner reception layer.

10. The smoothing system according to claim 8, wherein the toner reception layer having a lower glass transition temperature is smoothed at a lower pressure than the other toner reception layer.

11. The smoothing system according to claim 8, wherein the toner reception layer having a lower glass transition temperature is smoothed at a lower temperature than the other toner reception layer.

12. The smoothing system according to claim 8, wherein the smoothing unit includes a heating belt that heats the toner reception layers; a nip-forming member that forms a nip between the heating belt and the nip-forming member in which the toner reception layers are heated; and a cooling device that cools the recording material being conveyed in contact with the heating belt before separating the recording material.

13. An image-forming system comprising:

an image-forming unit that forms an image on a recording material including toner reception layers at both sides, toner reception layers having glass transition temperatures in the range of 40 to 80° C. with a difference of at least 5° C. therebetween; and a smoothing unit that smooths the toner reception layers on which images have been formed, by heating and pressing the toner reception layers, wherein the smoothing unit smooths the toner reception layer having a higher glass transition temperature prior to the other toner reception layer.

14. The image-forming system according to claim 13, further comprising a fixing device that thermally fixes toner images formed on the toner reception layers of the recording material in a nip, wherein the system is operable in an image-forming mode in which the toner reception layers of the recording material are sequentially smoothed by the smoothing unit after the toner images on the toner reception layers of the recording material are sequentially fixed by the fixing device.

15. The image-forming system according to claim 13, further comprising a detector that detects a front/back discrimination portion provided to a recording material; and a determination device that determines whether the toner reception layer having the higher glass transition is facing up or facing down based on an output from the detector.

16. The image-forming system according to claim 15, further comprising a cutter unit that cuts the smoothed recording material; and a collector that collects part of the cut recording material so as to be disposed of, wherein the cutter unit cuts the recording material such that the discrimination portion is collected with the collector.

* * * * *